US006991564B2

(12) United States Patent
Sajima

(10) Patent No.: US 6,991,564 B2
(45) Date of Patent: Jan. 31, 2006

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/750,827

(22) Filed: Jan. 5, 2004

(65) Prior Publication Data

US 2004/0152541 A1 Aug. 5, 2004

(30) Foreign Application Priority Data

Feb. 4, 2003 (JP) ..... 2003-027174

(51) Int. Cl.
*A63B 37/12* (2006.01)

(52) U.S. Cl. ..... 473/383

(58) Field of Classification Search ..... 473/379–385
See application file for complete search history.

(56) References Cited

U.S. PATENT DOCUMENTS 4,560,168 A 12/1985 Aoyama
5,078,402 A * 1/1992 Oka ..... 473/380
5,143,377 A * 9/1992 Oka et al. ..... 473/383
5,174,578 A 12/1992 Oka et al.
5,338,039 A 8/1994 Oka et al.
5,441,276 A * 8/1995 Lim ..... 473/378
5,586,951 A * 12/1996 Sugiura ..... 473/379
5,700,209 A * 12/1997 Sugiura ..... 473/380
6,705,959 B2 * 3/2004 Morgan et al. ..... 473/383
6,709,348 B1 * 3/2004 Lemons et al. ..... 473/378
6,719,646 B2 * 4/2004 Calabria et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

Surface of a golf ball 1 is comparted into 8 spherical regular triangles St and 6 spherical squares Ss by comparting lines that are formed by casting a reflection of sides of the cuboctahedron inscribed in the phantom spherical face onto the phantom spherical face. On the spherical regular triangle St are arranged regular triangular dimples A1. On the spherical square Ss are formed square dimples B1 and B2. Dimple patterns of respective spherical regular triangles St are identical with each other. Dimple patterns of respective spherical squares Ss are identical with each other. It is also permitted that the snub cube is envisioned, and the surface is comparted into spherical regular triangles St and spherical squares Ss. Surface area occupation percentage of dimples 4 is preferably equal to or greater than 70%.

15 Claims, 7 Drawing Sheets

GOLF BALL

This Nonprovisional application claims priority under 35 U.S.C. § 119(a) on Patent Application No(s). 2003-027174 filed in JAPAN on Feb. 4, 2003, the entire contents of which are hereby incorporated by reference.

BACKGROUND OF THE INVENTION

1. Field of the Invention

The present invention relates to golf balls. More particularly, the present invention relates to dimple patterns of golf balls.

2. Description of the Related Art

Golf balls have numerous dimples provided on the surface thereof. A role of the dimples involves causing turbulent flow detachment through disrupting the air flow around the golf ball during the flight (hereinafter, referred to as "dimple effect"). By causing the turbulent flow detachment, a detachment point of air from the golf ball shifts backwards leading to the reduction of a drag coefficient (Cd). The turbulent flow detachment promotes the difference of positions of the upper detachment point and the lower detachment point resulting from the back spin, thereby enhancing the lift force that acts upon the golf ball. Flight distance of the golf ball is prolonged on behalf of reduced drag and improvement of lift force. Aerodynamically excellent dimples promote the turbulent flow detachment. In other words, aerodynamically excellent dimples may render the air flow better.

For the arrangement of dimples, a polyhedron (in particular, regular polyhedron or semiregular polyhedron) is often employed. When a polyhedron is employed, a polyhedron inscribed in a phantom spherical face is envisioned, and comparting lines are formed by casting a reflection of sides of the polyhedron with a beam of light radiated from the center of the sphere onto the phantom spherical face. The phantom spherical face is comparted with these comparting lines, and the dimples are arranged accordingly. Examples of the regular polyhedron which may be employed include the regular hexahedron, regular octahedron, regular dodecahedron and regular icosahedron. In addition, illustrative examples of the semiregular polyhedron which may be employed include the icosidodecahedron and cuboctahedron. A dimple pattern arranged employing the icosidodecahedron is disclosed in JP-A No. 60-234674. A dimple pattern arranged employing the cuboctahedron is disclosed in JP-A No. 1-221182.

Various arts for improving the flight performance of a golf ball by modifying the plane shape of dimples have been proposed. For example, JP-A No. 4-220271 discloses a golf ball with adjacent two types of dimples having the different shape. JP-A No. 5-84328 discloses a golf ball provided with circular dimples and noncircular dimples. JP-A No. 5-96026 discloses a golf ball provided with dimples which are noncircular and have their sectional form with double slope. Persons skilled in the art are aware of great dimple effect achieved by noncircular dimples. Dimple effect of polygonal dimples is particularly great. Golf balls provided with polygonal dimples are excellent in flight performance.

In light of the improvement of appearance and the improvement of surface area occupation percentage of a golf ball, it is preferred that numerous polygonal dimples are arranged in an orderly array. Polygonal dimples have insufficient symmetry compared to circular dimples. When such polygonal dimples are arranged in an orderly array, there is the possibility that aerodynamic symmetry as a golf ball is impaired. An object of the present invention is to provide a golf ball which is excellent in flight performance and aerodynamic symmetry.

SUMMARY OF THE INVENTION

A golf ball according to the present invention has numerous dimples, which include polygonal dimples provided on the surface thereof. In this golf ball, when a phantom spherical face thereof is comparted into multiple spherical regular polygons with comparting lines formed by casting a reflection of sides of a semiregular polyhedron inscribed in the phantom spherical face onto the phantom spherical face, the spherical regular polygons include the dimples arranged therein. Proportion of the polygonal dimples occupied in total number of the dimples is equal to or greater than 50%. According to this golf ball, the polygonal dimples are responsible for the flight performance. According to this golf ball, the dimple pattern in which a semiregular polyhedron is employed is responsible for the aerodynamic symmetry. On behalf of the synergistic effects of the polygonal dimples and the semiregular polyhedron, excellent aerodynamic symmetry is imparted to the golf ball.

In light of the aerodynamic symmetry, when multiple first spherical regular polygons and multiple second spherical regular polygons are formed on a phantom spherical face with comparting lines, all the first spherical regular polygons preferably include the dimples arranged therein in a substantially equivalent manner with each other, and all the second spherical regular polygons preferably include the dimples arranged therein in a substantially equivalent manner with each other. In light of the aerodynamic symmetry, it is preferred that the comparting line does not substantially intersect with any dimple.

Preferably, on the first spherical regular polygon, regular polygonal dimples having the same number of vertices as the number of vertices of this first spherical regular polygon are mainly arranged, and on the second spherical regular polygon, regular polygonal dimples having the same number of vertices as the number of vertices of this second spherical regular polygon are mainly arranged. According to this golf ball, surface area occupation percentage (proportion of total area of dimples occupied in the area of the phantom spherical face) can be elevated.

Typically, the number of vertices of the first spherical regular polygon is 3, and the number of vertices of the second spherical regular polygon is 4. In other words, the first spherical regular polygon is the spherical regular triangle, and the second spherical regular polygon is the spherical square. By arranging regular triangular dimples mainly on the spherical regular triangles, and arranging square dimples mainly on the spherical squares, an excellent dimple effect is achieved.

Particularly preferable semiregular polyhedron is the cuboctahedron and the snub cube, on the grounds that they involve regular triangles and squares alone, and that the squares are not adjacent with each other.

When the snub cube is employed, a golf ball with no great circle path present on the surface can be obtained even though the comparting line does not intersect with any dimple. This golf ball is extremely excellent in aerodynamic symmetry. Surface area occupation percentage of the dimples is preferably equal to or greater than 70%.

DESCRIPTION OF THE PREFERRED EMBODIMENTS

The present invention is hereinafter described in detail with appropriate references to the accompanying drawing according to the preferred embodiments.

Figure 1:
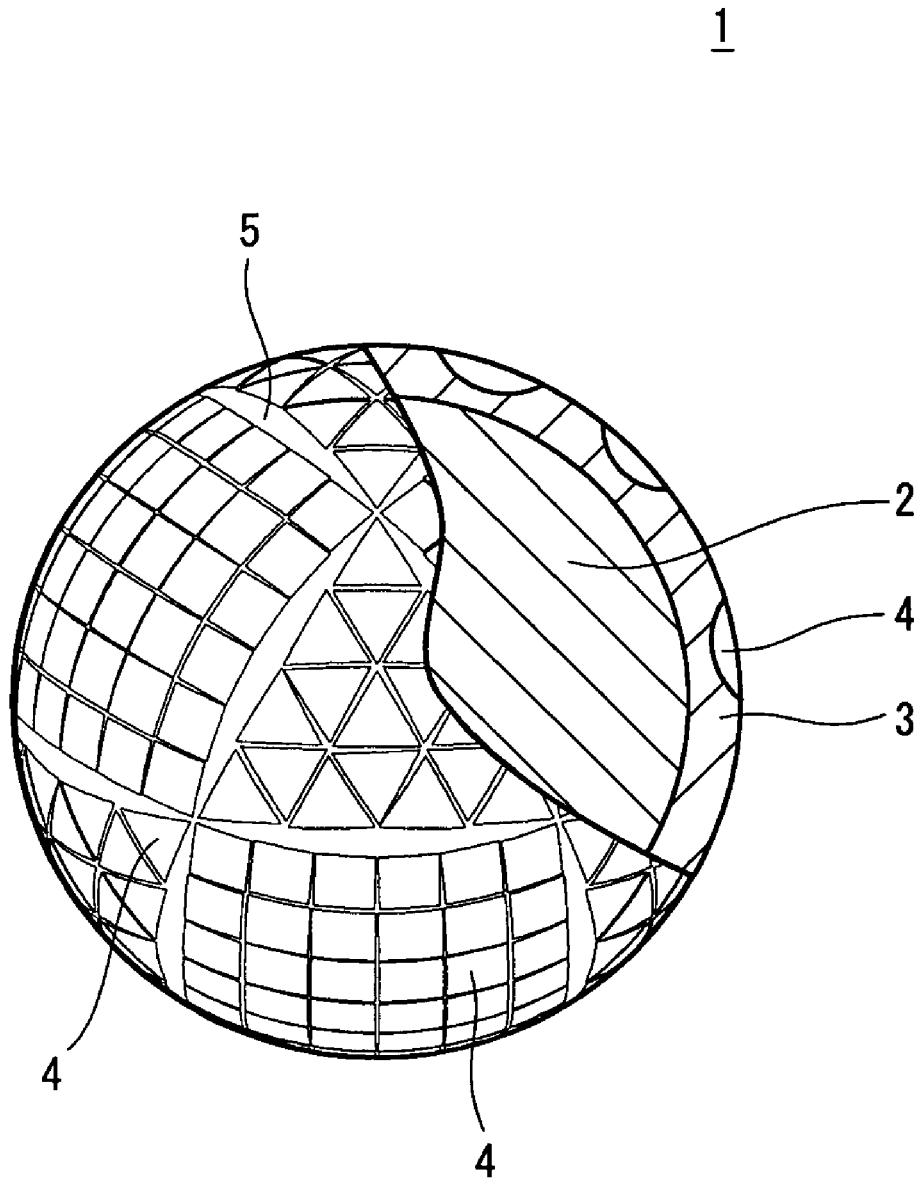
FIG. 1 is a partially cut off cross-sectional view illustrating a golf ball according to one embodiment of the present invention.

A golf ball 1 depicted in FIG. 1 has a spherical core 2 and a cover 3. Numerous dimples 4 are formed on the surface of the cover 3. Of the surface of the golf ball 1, a part except for the dimples 4 is a land 5. Although this golf ball 1 has a paint layer and a mark layer to the external side of the cover 3, these layers are not shown in the Figure.

This golf ball 1 has the diameter of from 40 mm to 45 mm in general, and in particular, of from 42 mm to 44 mm. In light of the reduction of air resistance in the range to comply with a rule defined by United States Golf Association (USGA), the diameter is particularly preferably 42.67 mm or greater and 42.80 mm or less. Weight of this golf ball 1 is generally 40 g or greater and 50 g or less, and in particular, 44 g or greater and 47 g or less. In light of the elevation of inertia in the range to comply with a rule defined by USGA, the weight is particularly preferably 45.00 g or greater and 45.93 g or less.

The core 2 is formed by crosslinking of a rubber composition. Illustrative examples of the base rubber for use in the rubber composition include polybutadienes, polyisoprenes, styrene-butadiene copolymers, ethylene-propylene-diene copolymers and natural rubbers. In light of the resilience performance, polybutadienes are preferred, and in particular, high cis polybutadienes are preferred. For crosslinking of the core 2, a co-crosslinking agent is usually used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of the suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Various kinds of additives such as a filler, sulfur, an anti-aging agent, a coloring agent, a plasticizer, a dispersant and the like may be blended in an appropriate amount to the rubber composition as needed. The diameter of the core 2 is generally 30.0 mm or greater and 42.0 mm or less, and particularly 38.0 mm or greater and 41.5 mm or less. The core 2 may be constituted from two or more layers.

The cover 3 is formed from a synthetic resin composition. Illustrative examples of the base resin for use in the cover 3 include ionomer resins, thermoplastic polyurethane elastomers, thermoplastic polyamide elastomers, thermoplastic polyester elastomers, thermoplastic styrene elastomers and thermoplastic polyolefin elastomers. To the cover 3 may be blended a coloring agent, a filler, a dispersant, an antioxidant, an ultraviolet absorbent, a light stabilizer, a fluorescent agent, a fluorescent brightening agent and the like in an appropriate amount as needed. The thickness of the cover 3 is generally 0.3 mm or greater and 6.0 mm or less, and in particular, 0.6 mm or greater and 2.4 mm or less. The cover 3 may be constituted from two or more layers.

Figure 2:
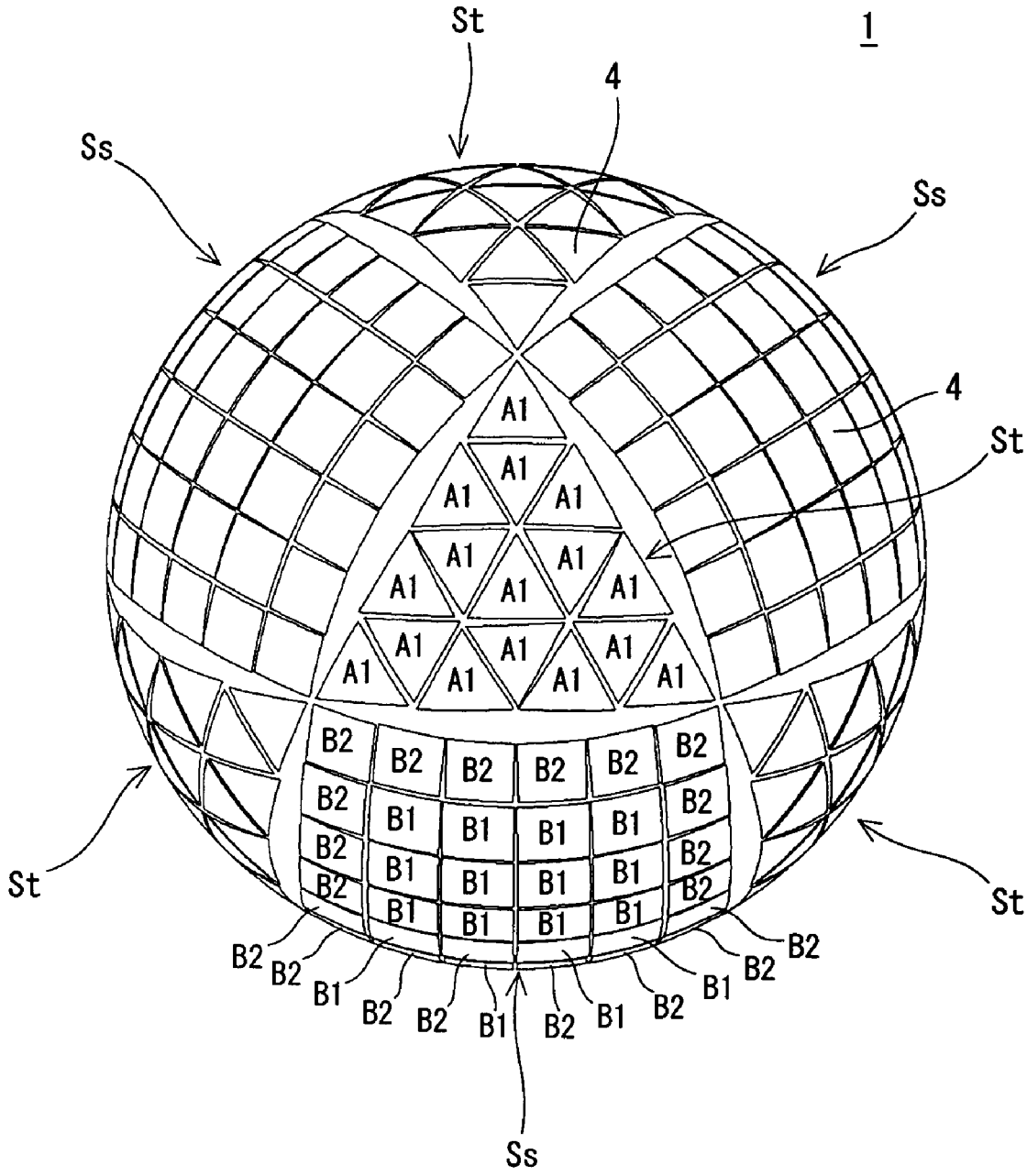
FIG. 2 is an enlarged plan view illustrating the golf ball shown in FIG. 1.
Figure 3:
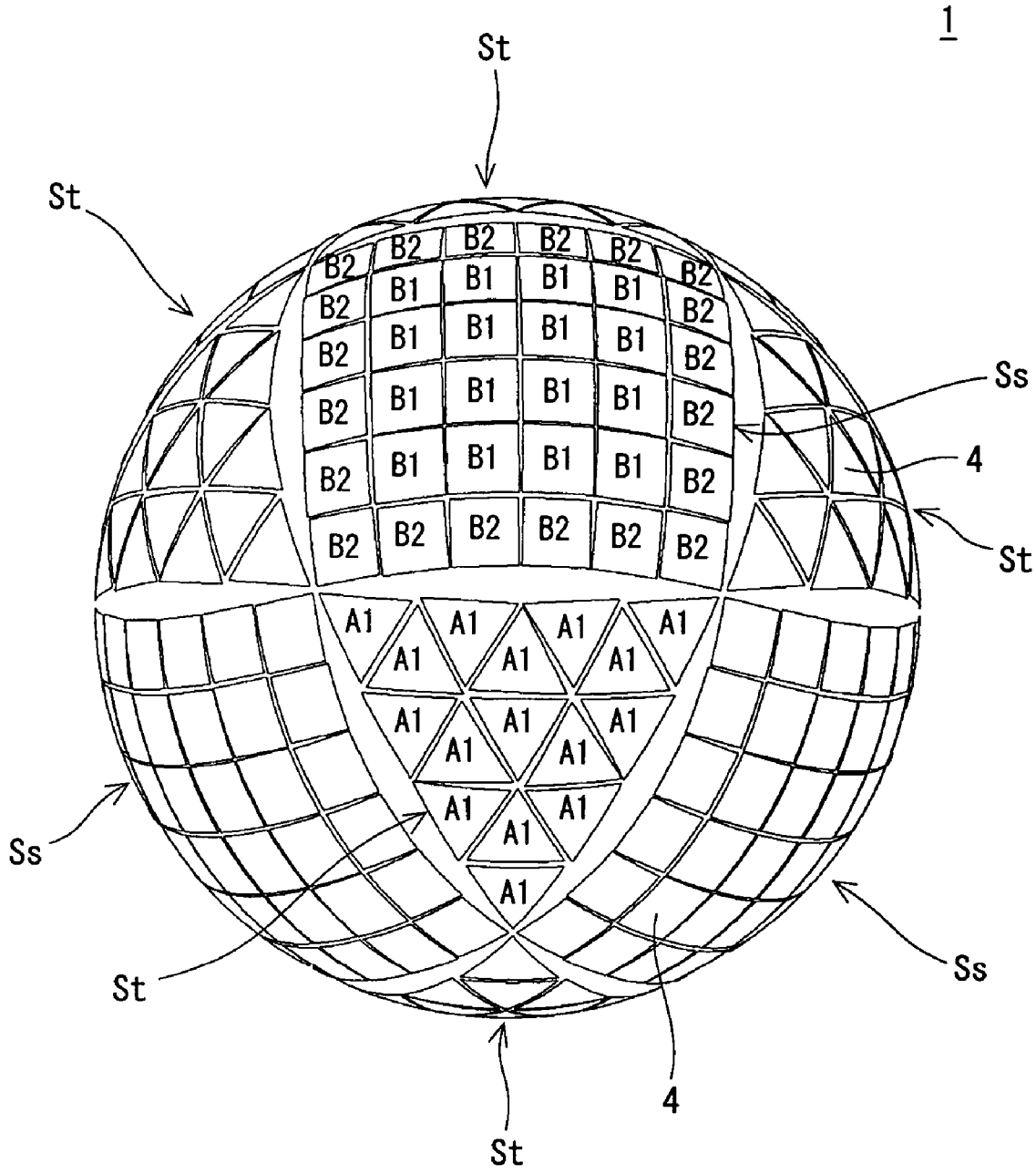
FIG. 3 is an enlarged front view illustrating the golf ball shown in FIG. 1.

FIG. 2 is an enlarged plan view illustrating the golf ball 1 shown in FIG. 1, and FIG. 3 is a front view of the same. In this golf ball 1, dimples 4 are arranged employing the cuboctahedron. Cuboctahedron is a kind of the semiregular polyhedrons. The cuboctahedron has 14 faces. Eight faces have a regular triangular shape, and 6 faces have a square shape. The cuboctahedron inscribed in a phantom spherical face is envisioned, and the phantom spherical face is comparted into 14 spherical regular polygons with 24 comparting lines formed by casting a reflection of 24 sides of this cuboctahedron. Dimples 4 are arranged on every this spherical regular polygon. The spherical regular polygons consist of two types, i.e., spherical regular triangles St, referred to as the first spherical regular polygon, and spherical squares Ss, referred to as the second spherical polygon. In this golf ball 1, there exist 8 spherical regular triangles St and 6 spherical squares Ss. The term "phantom spherical face" used herein means the surface of the golf ball 1 when it was postulated that no dimples 4 exist.

On the spherical regular triangle St of this golf ball 1, are formed dimples A1. In FIG. 2 and FIG. 3, the symbol (A1) indicating the type of the dimple 4 is assigned to only one spherical regular triangle St. Plane shape of the dimple A1 is substantially a regular triangle. The regular triangular dimples A1 are present within the spherical regular triangle St. Therefore, the regular triangular dimple A1 does not substantially intersect with the comparting line (not shown in the Figure). As a matter of course, the regular triangular dimple A1 may intersect with a comparting line. Because the regular triangular dimple A1 exists on the spherical face, three sides have a circular arc shape in the strict aspect. The number of vertices of the regular triangular dimple A1 is 3, and the number of vertices of the spherical regular triangle St is also 3. Thus, the number of both vertices is identical. In other words, the regular triangular dimple A1 is substantially similar to the spherical regular triangle St. By arranging dimples which are substantially similar on the spherical regular triangle St, density of the dimples can be elevated. Although polygonal dimples other than the regular triangular dimple, or circular dimples may be arranged on the spherical regular triangle St, it is preferred that regular triangular dimples A1 are mainly arranged. Specifically, the ratio Rt represented by the following formula (I) is preferably equal to or greater than 50%, more preferably equal to or greater than 65%, still more preferably equal to or greater than 80%, and most preferably 100%.

$$Rt=(Nt/Nd)\cdot 100 \quad \text{(I)}$$

In this formula, Nd represents the number of dimples 4 included in the spherical regular triangle St, and Nt represents the number of the regular triangular dimples A1 included in the spherical regular triangle St. Dimples included in the spherical regular triangle St mean dimples of which center of gravity is included in the spherical regular triangle St. Two or more types of regular triangular dimples may be formed on the spherical regular triangle St. In this instance, total number of all the regular triangular dimples is defined as Nt.

According to this golf ball 1, dimple patterns of 8 spherical regular triangles St are substantially identical with each other. Aerodynamic symmetry of the golf ball 1 can be thereby improved. The state in which dimple patterns are substantially identical involves the cases where dimple patterns to be compared are completely identical with each other, as well as the cases where both patterns are somewhat different owing to an error during the production, and also the cases where a minor difference between both patterns is intentionally obliged for the sake of a convenience of forming a golf ball 1 (e.g., conveniences for providing a core holding pin, a bent pin, an injection gate, a parting line and the like). The dimple patterns of the 8 spherical regular triangles St may be substantially equivalent with each other. Also in such a case, aerodynamic symmetry of the golf ball 1 is excellent. The equivalent state involves the cases where dimple patterns to be compared are identical with each other, as well as the cases where they are rotation symmetric and the cases where they are mirror symmetric.

On the spherical square Ss of this golf ball 1 are formed large dimples B1 and small dimples B2. In FIG. 2 and FIG. 3, the symbols (B1, B2) indicating the types of the dimple 4 are assigned to only one spherical square Ss. Plane shape of the dimples B1 and B2 are substantially square. The square dimples B1 and B2 are present within the spherical square Ss. Therefore, the square dimples B1 and B2 do not substantially intersect with the comparting line (not shown in the Figure). As a matter of course, the square dimples B1 and B2 may intersect with a comparting line. Because the square dimples B1 and B2 exist on the spherical face, four sides have a circular arc shape in the strict aspect. The number of vertices of the square dimples B1 and B2 is 4, and the number of vertices of the spherical square Ss is also 4. Thus, the number of both vertices is identical. In other words, the square dimples B1 and B2 are substantially similar to the spherical square Ss. By arranging dimples 4 which are substantially similar to the spherical square Ss, density of the dimples 4 can be elevated. Although polygonal dimples other than the square dimple, or circular dimples may be arranged on the spherical square Ss, it is preferred that square dimples B1 and B2 are mainly arranged. Specifically, the ratio Rs represented by the following formula (II) is preferably equal to or greater than 50%, more preferably equal to or greater than 65%, still more preferably equal to or greater than 80%, and most preferably 100%.

$$Rs=(Ns/Nd)\cdot 100 \quad \text{(II)}$$

In this formula, Nd represents the number of dimples 4 included in the spherical square Ss, and Ns represents the number of the square dimples B1 and B2 included in the spherical square Ss. Dimples included in the spherical square Ss mean dimples of which center of gravity is included in the spherical square Ss.

According to this golf ball 1, dimple patterns of 6 spherical squares Ss are substantially identical with each other. Aerodynamic symmetry of the golf ball 1 can be thereby improved. The dimple patterns of the 6 spherical squares Ss may be substantially equivalent with each other. Also in such a case, aerodynamic symmetry of the golf ball 1 is excellent.

Because the regular triangular dimple A1, and the square dimples B1 and B2 have comparatively small number of vertices, particularly excellent dimple effect is achieved among polygonal dimples. On the other hand, the number of symmetric axes of the regular triangular dimple A1 is only 3, and the number of symmetric axes of the square dimples B1 and B2 is only 4. Dimples with less symmetric axes have aerodynamic anisotropy. In a dimple pattern provided by employing the cuboctahedron, the surface of the golf ball 1 is comparted into spherical regular triangles St and spherical squares Ss. Thus, the surface of the ball is rich in variety. Accordingly, even though regular polygonal dimples are arranged in an orderly array on the spherical regular triangles St and spherical squares Ss, aerodynamic symmetry as a whole of the golf ball 1 is hardly impaired. By arranging the regular polygonal dimples on the spherical regular triangles St and spherical squares Ss in an orderly array, surface area occupation percentage can be elevated. Greater surface area occupation percentage is responsible for the flight performance of the golf ball 1. By arranging the regular polygonal dimples on the spherical regular triangles St and spherical squares Ss in an orderly array, appearance of the golf ball 1 can be also improved.

Effects of arrangement of dimples in an orderly array, accompanied by excellent aerodynamic symmetry can be also achieved according to the semiregular polyhedron other than the cuboctahedron (3, 4, 3, 4). Examples of other semiregular polyhedron include the truncated tetrahedron (3, 6, 6), truncated hexahedron (3, 8, 8), truncated octahedron (4, 6, 6), truncated dodecahedron (3, 10, 10), truncated icosahedron (5, 6, 6), icosidodecahedron (3, 5, 3, 5), rhombitruncated cuboctahedron (4, 6, 8), rhombitruncated icosidodecahedron (4, 6, 10), rhombicuboctahedron (3, 4, 4, 4), Miller's polyhedron (3, 4, 4, 4), rhombicosidodecahedron (3, 4, 5, 4), snub cube (3, 3, 3, 3, 4), and snub dodecahedron (3, 3, 3, 3, 5). Parenthesizes numerical characters described above represent the number of sides of multiple polygons, respectively, which share one vertex. On the ground that regular triangular dimples and square dimples that may achieve excellent dimple effect can be arranged in an orderly array, the cuboctahedron, snub cube, rhombicuboctahedron and Miller's polyhedron are preferred. The cuboctahedron, snub cube, rhombicuboctahedron and Miller's polyhedron are constituted from only regular triangles and squares. In particular, when the cuboctahedron or the snub cube is employed, a golf ball that is excellent in aerodynamic symmetry can be obtained because spherical squares are not adjacent with each other.

In light of the flight performance, the ratio R represented by the following formula (III) is preferably equal to or greater than 50%, more preferably equal to or greater than 65%, still more preferably equal to or greater than 80%, and most preferably 100%.

$$R=(Np/Nd)\cdot 100 \quad \text{(III)}$$

In this formula, Nd represents total number of dimples 4 on the golf ball 1, and Np represents the number of polygonal dimples on the golf ball 1.

The surface area occupation percentage is preferably equal to or greater than 70%. When the surface area occupation percentage is less than the above range, sufficient dimple effect is not achieved, and the flight performance of the golf ball 1 may be insufficient. In this respect, the surface area occupation percentage is more preferably equal to or greater than 75%, still more preferably equal to or greater than 80%, and particularly preferably equal to or greater than 85%. The surface area occupation percentage is usually set to be equal to or less than 95%. The surface area occupation percentage is a proportion of total area of dimples occupied in the area of the phantom spherical face.

The area of the dimple 4 refers to an area of a geometric figure surrounded by the dimple edge line when the center of the golf ball 1 is viewed at infinity.

Area of individual dimples 4 is preferably 3 $mm^2$ or greater and 30 $mm^2$ or less. When the area is less than the above range, dimple effect may be hardly achieved. In this respect, the area is more preferably equal to or grater than 4 $mm^2$, and particularly preferably equal to or grater than 5 $mm^2$. When the area is beyond the above range, the fundamental feature of the golf ball which is a substantially spherical body may be deteriorated. In this respect, the area is more preferably equal to or less than 25 $mm^2$, and particularly preferably equal to or less than 20 $mm^2$. Depth of the dimple 4 is in general, set to be 0.08 mm or greater and 0.60 mm or less, still more, 0.10 mm or greater and 0.55 mm or less, and particularly, 0.12 mm or greater and 0.50 mm or less. The depth of the dimple 4 is the greatest distance between the surface of the dimple 4 and the phantom spherical face.

Total volume of the dimples 4 is preferably 400 $mm^3$ or greater and 750 $mm^3$ or less. When the total volume is less than the above range, hopping trajectory may be provided. In this respect, the total volume is more preferably equal to or greater than 450 $mm^3$, and particularly preferably equal to or greater than 470 $mm^3$. When the total volume is beyond the above range, dropping trajectory may be provided. In this respect, the total volume is more preferably equal to or less than 700 $mm^3$, and particularly preferably equal to or less than 680 $mm^3$. The volume of the dimple 4 refers to volume of a part surrounded by a phantom spherical surface and the surface of the dimple 4.

Total number of the dimples 4 is preferably 200 or greater and 500 or less. When the total number is less than the above range, to achieve the dimple effect becomes difficult. In this respect, the total number is more preferably equal to or more than 220, and particularly preferably equal to or more than 240. When the total number is beyond the above range, to achieve the dimples effect becomes difficult due to small size of the individual dimples 4. In this respect, the total number is more preferably equal to or less than 480, and particularly preferably equal to or less than 460.

Figure 4:
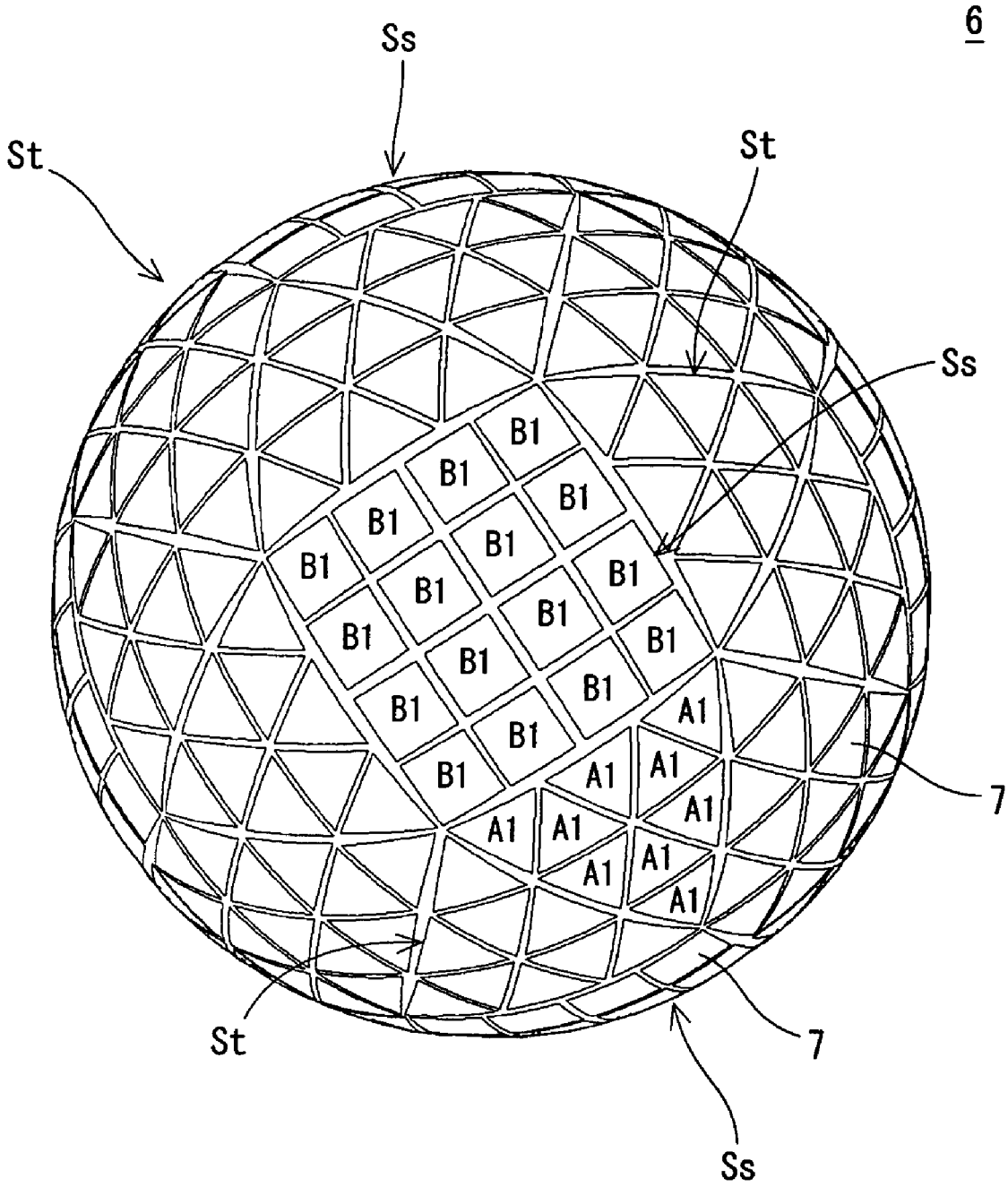
FIG. 4 is a plan view illustrating a golf ball according to another embodiment of the present invention.
Figure 5:
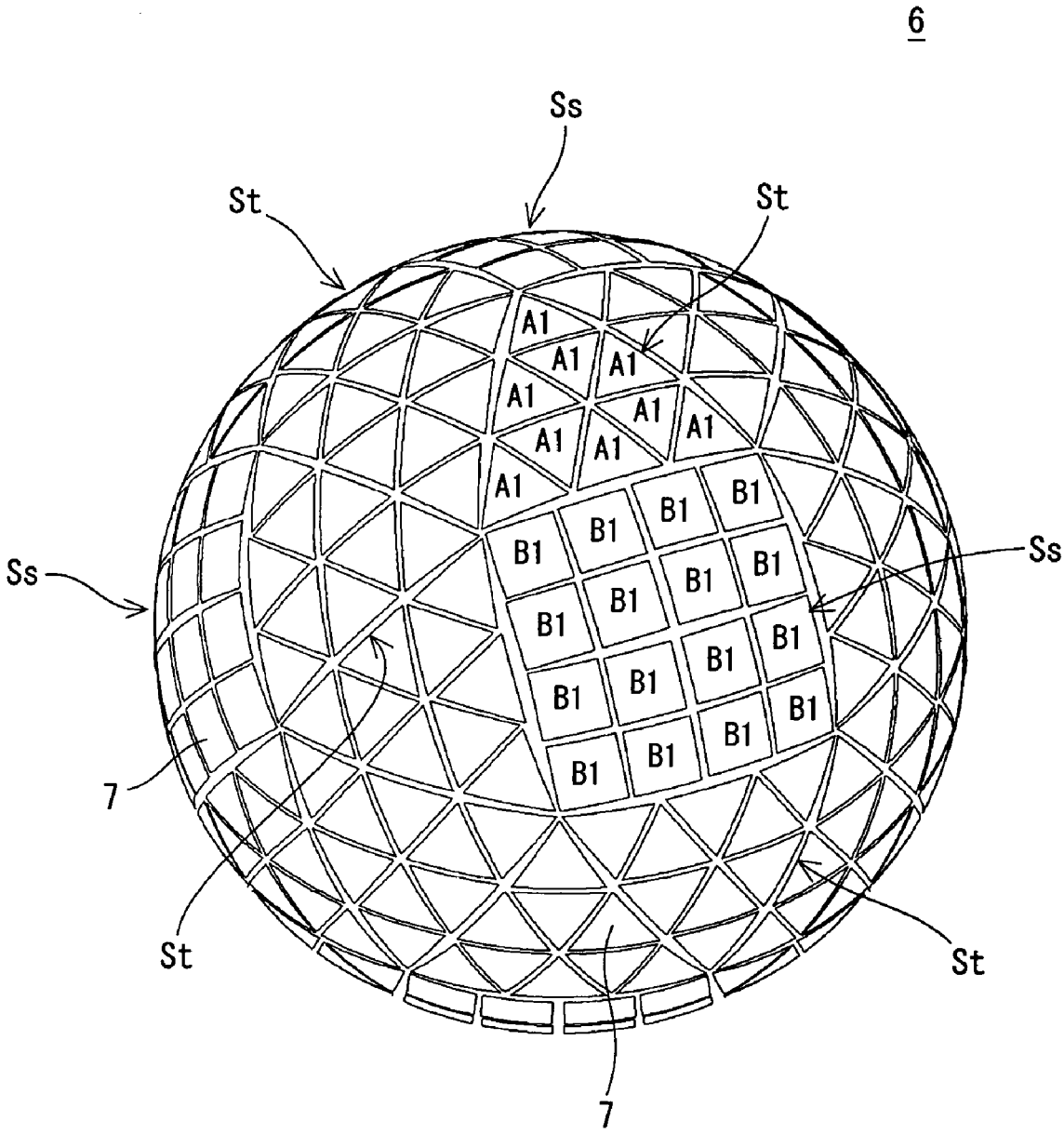
FIG. 5 is a front view illustrating the golf ball shown in FIG. 4.

FIG. 4 is a plan view illustrating a golf ball 6 according to another embodiment of the present invention, and FIG. 5 is a front view of the same. In this golf ball 6, dimples 7 are arranged employing the snub cube which is a kind of the semiregular polyhedrons. The snub cube has 38 faces. Thirty two faces have a regular triangle shape, and 6 faces have a square shape. The snub cube inscribed in a phantom spherical face is envisioned, and the phantom spherical face is comparted into 38 spherical regular polygons with 60 comparting lines formed by casting a reflection of 60 sides of this snub cube. Dimples 7 are arranged on every this spherical regular polygon. The spherical regular polygons consist of two types, i.e., spherical regular triangles St, referred to as the first spherical regular polygon, and spherical squares Ss, referred to as the second spherical polygon. In this golf ball 6, there exist 32 spherical regular triangles St and 6 spherical squares Ss.

On the spherical regular triangle St of this golf ball 6, are formed dimples A1. In FIG. 4 and FIG. 5, the symbol (A1) indicating the type of the dimple 7 is assigned to only one spherical regular triangle St. Plane shape of the dimple A1 is substantially a regular triangle. The regular triangular dimples A1 are present within the spherical regular triangle St. Therefore, the regular triangular dimple A1 does not substantially intersect with the comparting line (not shown in the Figure). As a matter of course, the regular triangular dimple A1 may intersect with a comparting line. Because the regular triangular dimple A1 exists on the spherical face, three sides have a circular arc shape in the strict aspect. The number of vertices of the regular triangular dimple A1 is 3, and the number of vertices of the spherical regular triangle St is also 3. Thus, the number of both vertices is identical. In other words, the regular triangular dimple A1 is substantially similar to the spherical regular triangle St. By arranging dimples 7 which are substantially similar to the spherical regular triangle St, density of the dimples 7 can be elevated. Although polygonal dimples other than the regular triangular dimple, or circular dimples may be arranged on the spherical regular triangle St, it is preferred that regular triangular dimples A1 are mainly arranged. Specifically, the ratio Rt represented by the above formula (I) is preferably equal to or greater than 50%, more preferably equal to or greater than 65%, still more preferably equal to or greater than 80%, and most preferably 100%.

According to this golf ball 6, dimple patterns of 32 spherical regular triangles St are substantially identical with each other. The dimple patterns of the 32 spherical regular triangles St may be substantially equivalent with each other. In either a substantially identical case or a substantially equivalent case, aerodynamic symmetry of the golf ball 6 can be improved.

On the spherical square Ss of this golf ball 6 are formed dimples B1. In FIG. 4 and FIG. 5, the symbol (B1) indicating the type of the dimple 7 is assigned to only one spherical square Ss. Plane shape of the dimple B1 is substantially square. The square dimple B1 is present within the spherical square Ss. Therefore, the square dimple B1 does not substantially intersect with the comparting line (not shown in the Figure). As a matter of course, the square dimple B1 may intersect with a comparting line. Because the square dimple B1 exists on the spherical face, four sides have a circular arc shape in the strict aspect. The number of vertices of the square dimple B1 is 4, and the number of vertices of the spherical square Ss is also 4. Thus, the number of both vertices is identical. In other words, the square dimple B1 is substantially similar to the spherical square Ss. By arranging dimples 7 which are substantially similar to the spherical square Ss, density of the dimples 7 can be elevated. Although polygonal dimples other than the square dimple, or circular dimples may be arranged on the spherical square Ss, it is preferred that square dimples B1 are mainly arranged. Specifically, the ratio Rs represented by the above formula (II) is preferably equal to or greater than 50%, more preferably equal to or greater than 65%, still more preferably equal to or greater than 80%, and most preferably 100%.

According to this golf ball 6, dimple patterns of 6 spherical squares Ss are substantially identical with each other. The dimple patterns of the 6 spherical squares Ss may be substantially equivalent with each other. In either a substantially identical case or a substantially equivalent case, aerodynamic symmetry of the golf ball 6 can be improved.

In this golf ball 6, flight performance is improved on behalf of the regular triangular dimples A1 and the square dimples B1. Because the snub cube is employed for this golf ball 6, the surface of the ball is rich in variety. Accordingly, even though regular polygonal dimples are arranged in an orderly array on the spherical regular triangles St and spherical squares Ss, aerodynamic symmetry as a whole of the golf ball is hardly impaired. By arranging the regular polygonal dimples on the spherical regular triangles St and spherical squares Ss in an orderly array, surface area occupation percentage can be elevated. Greater surface area occupation percentage is responsible for the flight performance of the golf ball 6. By arranging the regular polygonal dimples on the spherical regular triangles St and spherical squares Ss in an orderly array, appearance of the golf ball 6 can be also improved.

According to the dimple pattern provided employing the snub cube, comparting lines are not serially aligned on one great circle. Therefore, even in the cases where a comparting line does not intersect with a dimple 7, a great circle path along the comparting line is not formed. This golf ball 6 does not have any great circle path at all. This golf ball 6 is extremely excellent in aerodynamic symmetry.

EXAMPLES

Example 1

A core consisting of a solid rubber was placed into a mold, and an ionomer resin composition was injected around the core to form a cover layer. Accordingly, the golf ball of Example 1 having a dimple pattern illustrated in FIG. 2 and FIG. 3 was obtained. External diameter of the ball was 42.70±0.03 mm, and the compression was 85±2.

Example 2 and Comparative Example 1

Figure 6:
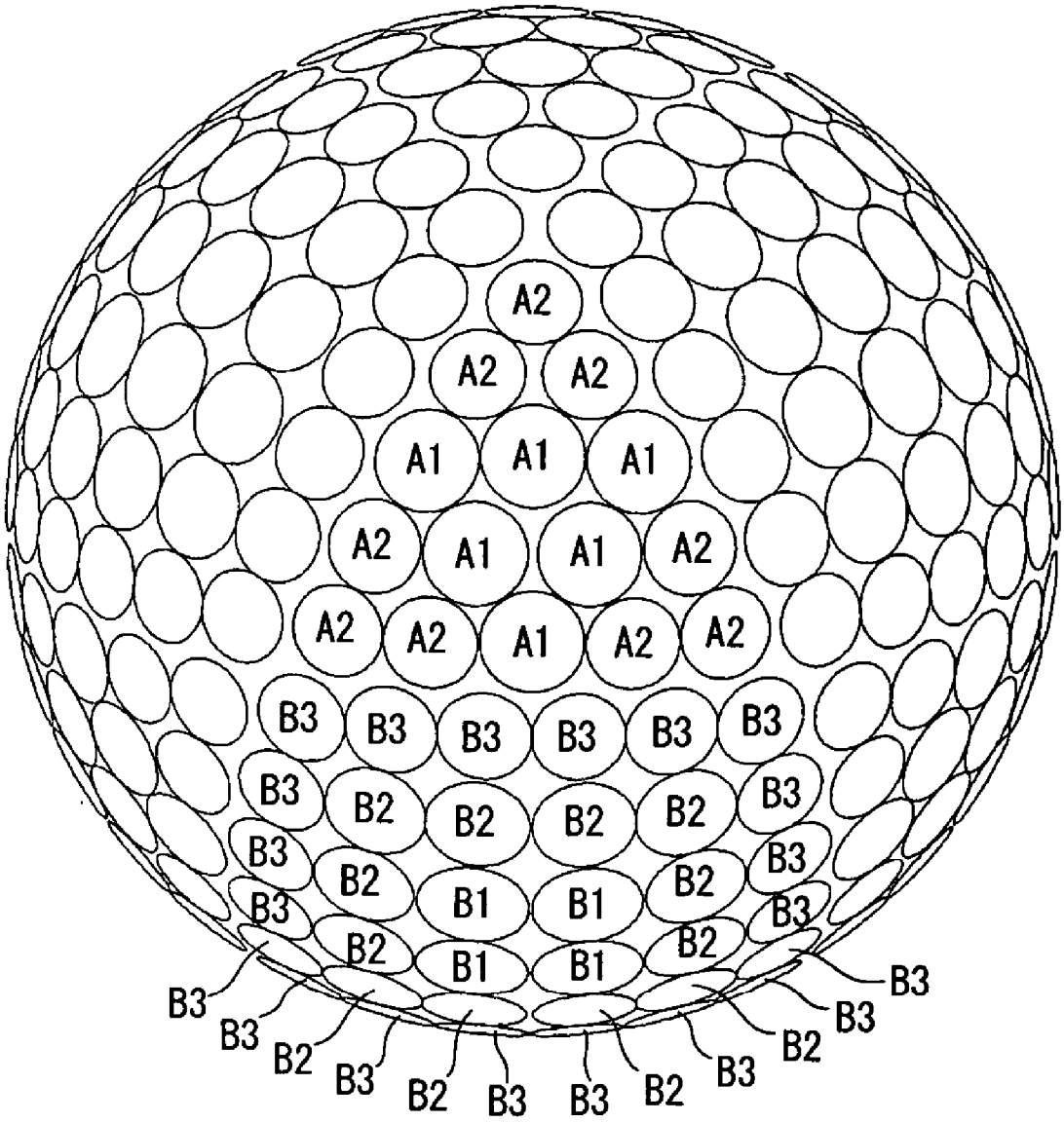
FIG. 6 is a plan view illustrating a golf ball according to Comparative Example 1.
Figure 7:
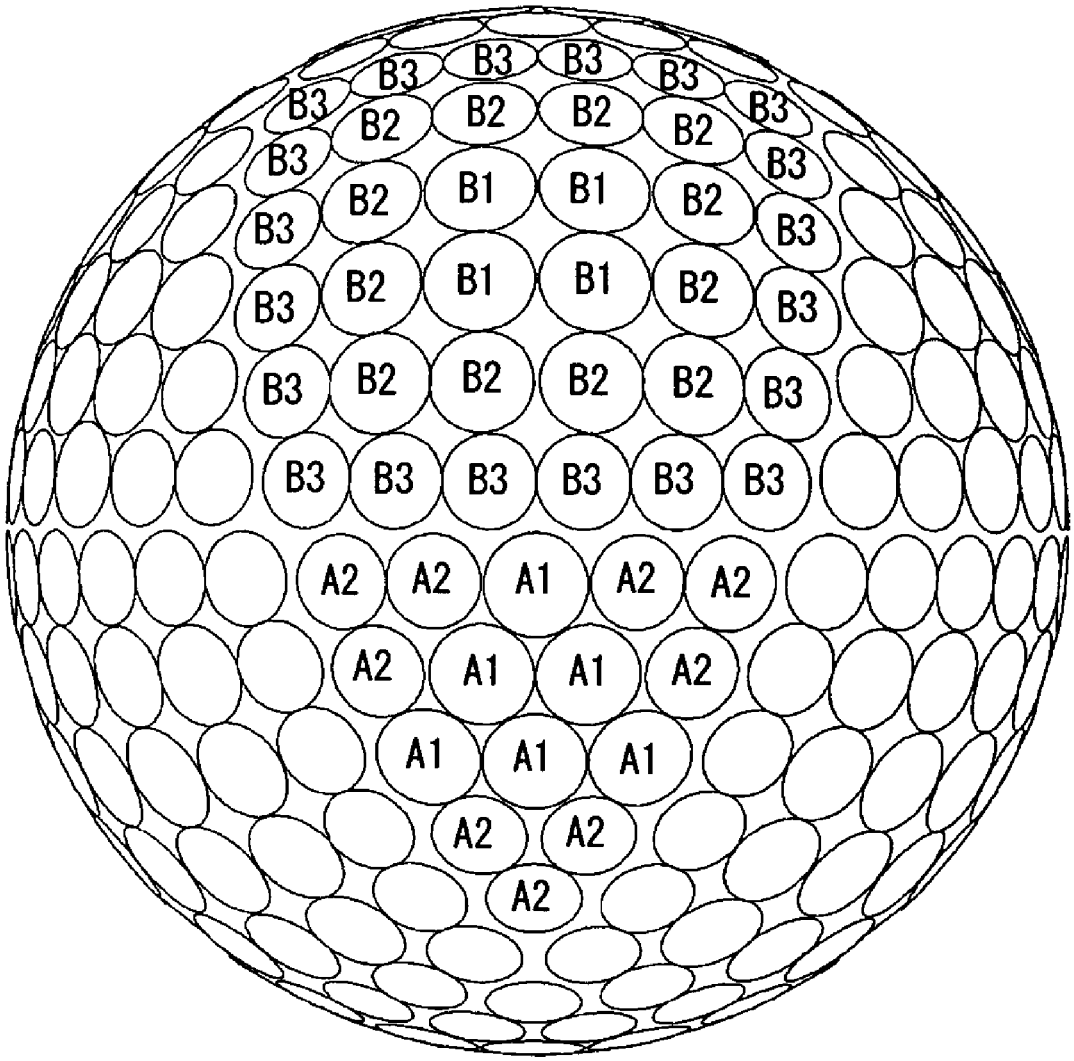
FIG. 7 is a front view illustrating the golf ball shown in FIG. 6.

In a similar manner to Example 1 except that the mold was changed, the golf ball of Example 2 having a dimple pattern illustrated in FIG. 4 and FIG. 5, and the golf ball of Comparative Example 1 having a dimple pattern illustrated in FIG. 6 and FIG. 7 were obtained. The dimple pattern of the golf ball of Comparative Example 1 was obtained employing the cuboctahedron, in a similar manner to Example 1.

[Flight Distance Test]

A driver with a metal head (W1) was equipped with a swing machine manufactured by True Temper Co, which was adjusted to the machinery condition to give the head speed of about 49 m/sec, launch angle of about 11°, and back spin speed of about 3000 rpm. Then, each golf ball was hit therewith, and the flight distance (i.e., the distance from the launching point to the point of fall) was measured. The condition during the test was with head wind of which average wind speed of about 1 m/s. Twenty times measurement for pole hitting and seam hitting was respectively conducted. Mean value of 20 data and the difference between data of pole hitting and data of seam hitting are presented in Table 2 below. Pole hitting is a method of hitting in which a rotation axis of back spin is included in the parting face of the mold of the golf ball. Seam hitting is a method of hitting in which a rotation axis of back spin is vertical to the parting face of the mold of the golf ball.

TABLE 2

Results of Flight Distance Test

| | Example 1 | Example 2 | Comparative Example 1 |
|---|---|---|---|
| Pole hitting x (m) | 231.3 | 232.5 | 230.0 |
| Seam hitting y (m) | 230.5 | 232.0 | 228.5 |
| Difference x–y (m) | 0.8 | 0.5 | 1.5 |

As is shown in Table 2, the flight distance of the golf balls of Examples 1 and 2 is greater than the flight distance of the golf balls of Comparative Example 1. In addition, the difference resulted from the golf balls in Examples 1 and 2 are less than the difference resulted from the golf balls in Comparative Example 1. Accordingly, advantages of the present invention are clearly indicated by these results of evaluation.

TABLE 1

Specification of Dimples

| | | Symbol | Plane shape | Number | Size (mm) | Area ($mm^2$) | Volume ($mm^3$) | Depth (mm) | Rt Rs (%) | R (%) | Total number | Total area ($mm^2$) | Total volume ($mm^3$) | Y (%) | Plan view Front view |
|---|---|---|---|---|---|---|---|---|---|---|---|---|---|---|---|
| Example 1 | spherical regular triangle | A1 | regular triangle | 16 | 5.925 | 11.40 | 1.500 | 0.339 | 100 | 100 | 344 | 4420 | 549 | 77.2 | FIG. 2 FIG. 3 |
| | spherical square | B1 | square | 16 | 5.400 | 14.58 | 1.720 | 0.295 | 100 | | | | | | |
| | | B2 | square | 20 | 5.100 | 13.01 | 1.600 | 0.316 | | | | | | | |
| Example 2 | spherical regular triangle | A1 | regular triangle | 9 | 5.463 | 9.69 | 1.440 | 0.229 | 100 | 100 | 384 | 4420 | 549 | 77.2 | FIG. 4 FIG. 5 |
| | spherical square | B1 | square | 16 | 5.825 | 16.97 | 1.400 | 0.331 | 100 | | | | | | |
| Comparative Example 1 | spherical regular triangle | A1 | circular | 6 | 4.300 | 14.52 | 1.869 | 0.257 | 0 | 0 | 336 | 4422 | 549 | 77.2 | FIG. 6 FIG. 7 |
| | | A2 | circular | 9 | 3.900 | 11.95 | 1.422 | 0.238 | | | | | | | |
| | spherical square | B1 | circular | 4 | 4.525 | 16.08 | 2.163 | 0.269 | 0 | | | | | | |
| | | B2 | circular | 12 | 4.300 | 14.52 | 1.869 | 0.257 | | | | | | | |
| | | B3 | circular | 20 | 3.900 | 11.95 | 1.422 | 0.238 | | | | | | | |

Size: Diameter of circumscribed circle for the regular triangular dimple, and diameter for the circular dimple
Rt: Proportion occupied by regular triangular dimples
Rs: Proportion occupied by square dimples
Y: Surface area occupation percentage of dimples The description herein above is merely for illustrative examples, therefore, various modifications can be made without departing from the principles of the present invention.

What is claimed is:

1. A golf ball having numerous dimples, which include polygonal dimples, provided on the surface thereof, wherein a phantom spherical face of the golf ball is comparted into multiple spherical regular polygons with comparting lines formed by casting a reflection of sides of a semiregular polyhedron inscribed in the phantom spherical face onto the phantom spherical face, the spherical regular polygons include the dimples arranged therein;

wherein said spherical regular polygons include multiple first spherical regular polygons and multiple second spherical regular polygons that have a different number of vertices from that of said first spherical regular polygons formed with said comparting lines, all the first spherical regular polygons include the dimples arranged therein in a substantially equivalent manner with each other, and all the second spherical regular polygons include the dimples arranged therein in a substantially equivalent manner with each other;

wherein on each of said first spherical regular polygons, regular polygonal dimples each having the same number of vertices as the number of vertices of one of said first spherical regular polygons are mainly arranged, and on each of said second spherical regular polygons, regular polygonal dimples each having the same number of vertices as the number of vertices of one of said second spherical regular polygons are mainly arranged and the proportion of the polygonal dimples with respect to the total number of the dimples is equal to or greater than 50%.

2. The golf ball according to claim 1, wherein said comparting line does not substantially intersect with any dimple.

3. The golf ball according to claim 1, wherein the number of vertices of one of said first spherical regular polygons is three and the number of vertices of one of said second spherical regular polygons is four.

4. The golf ball according to claim 3, wherein said semiregular polyhedron is the cuboctahedron.

5. The golf ball according to claim 3, wherein said semiregular polyhedron is the snub cube.

6. The golf ball according to claim 5, wherein said comparting line does not intersect with any dimple, and wherein no great circle path is present on the surface of the golf ball.

7. The golf ball according to claim 1, wherein the proportion of total area of said dimples occupied with respect to the area of said phantom spherical face is equal to or greater than 70%.

8. The golf ball according to claim 1, wherein the proportion of regular polygonal dimples each having the same number of vertices as the number of vertices of one of said first spherical regular polygons disposed within each of said first spherical regular polygons is equal to or greater than 65%, and wherein the proportion of regular polygonal dimples each having the same number of vertices as the number of vertices of one of said second spherical regular polygons disposed within each of said second spherical regular polygons is equal to or greater than 65%.

9. The golf ball according to claim 1, wherein the proportion of regular polygonal dimples each having the same number of vertices as the number of vertices of one of said first spherical regular polygons disposed within each of said first spherical regular polygons is equal to or greater than 80%, and wherein the proportion of regular polygonal dimples each having the same number of vertices as the number of vertices of one of said second spherical regular polygons disposed within each of said second spherical regular polygons is equal to or greater than 80%.

10. The golf ball according to claim 1, wherein the proportion of the polygonal dimples with respect to the total number of dimples is equal to or greater than 65%.

11. The golf ball according to claim 1, wherein the proportion of the polygonal dimples with respect to the total number of dimples is equal to or greater than 80%.

12. The golf ball according to claim 1, wherein the proportion of the polygonal dimples with respect to the total number of dimples is 100%.

13. The golf ball according to claim 1, wherein the proportion of total area of said dimples occupied with respect to the area of said phantom spherical face is equal to or greater than 75% and equal to or less than 95%.

14. The golf ball according to claim 1, wherein the proportion of total area of said dimples occupied with respect to the area of said phantom spherical face is equal to or greater than 80% and equal to or less than 95%.

15. The golf ball according to claim 1, wherein the proportion of total area of said dimples occupied with respect to the area of said phantom spherical face is equal to or greater than 85% and equal to or less than 95%.

* * * * *